US011264736B2

(12) United States Patent
Ruggiero et al.

(10) Patent No.: US 11,264,736 B2
(45) Date of Patent: Mar. 1, 2022

(54) INSULATION PIERCING CONNECTOR

(71) Applicant: Hubbell Incorporated, Shelton, CT (US)

(72) Inventors: Glen Harrison Ruggiero, Manchester, NH (US); Richard E. Robicheau, Litchfield, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 16/544,695

(22) Filed: Aug. 19, 2019

(65) Prior Publication Data

US 2020/0059013 A1 Feb. 20, 2020

Related U.S. Application Data

(60) Provisional application No. 62/719,934, filed on Aug. 20, 2018.

(51) Int. Cl.
*H01R 4/36* (2006.01)
*H01R 4/2483* (2018.01)

(52) U.S. Cl.
CPC ..... *H01R 4/2483* (2013.01); *H01R 4/36* (2013.01)

(58) Field of Classification Search
CPC ..... H01R 4/30
See application file for complete search history.

(56) References Cited

U.S. PATENT DOCUMENTS 2,359,256 A * 9/1944 Spence ..... H01R 4/2408 439/416
2,597,037 A 5/1952 Runde
2,938,069 A 5/1960 Toedtman et al.
2,956,108 A 10/1960 Brenner
3,113,822 A * 12/1963 Sorflaten ..... H01R 4/26 439/814
3,191,139 A * 6/1965 Schiffmann ..... H01R 4/2483 439/412
3,322,888 A 5/1967 Brenner
3,354,517 A 11/1967 Levinsky
3,710,303 A 1/1973 Gallager, Jr.
3,746,777 A 7/1973 Peek
3,781,459 A 12/1973 Peek
4,050,761 A 9/1977 De France
4,080,034 A 3/1978 Werner
4,293,176 A 10/1981 Lindlof
4,350,843 A 9/1982 Campbell et al.
4,427,253 A 1/1984 Smith et al.
4,640,571 A * 2/1987 Walter ..... H01R 4/366 439/791
5,036,164 A 7/1991 Schrader et al.
5,103,068 A 4/1992 Schrader
5,162,615 A 11/1992 Schrader et al.
(Continued)

OTHER PUBLICATIONS

YH292C Data Sheet Burndy Electrical (FCI USA Inc.) Dec. 28, 1990, Rev. 9.

(Continued)

*Primary Examiner* — Felix O Figueroa
(74) *Attorney, Agent, or Firm* — Wissing Miller LLP

(57) ABSTRACT

Mechanical-type electrical connectors having insulation piercing screws used to create an electrically conductive path between a run conductor secured to the connector and a branch conductor secured to the connector are provided.

20 Claims, 8 Drawing Sheets

(56) References Cited

U.S. PATENT DOCUMENTS

| | | | | |
|---|---|---|---|---|
| 5,200,576 | A | 4/1993 | Schrader et al. | |
| 5,396,033 | A | 3/1995 | Piriz et al. | |
| 5,552,564 | A | 9/1996 | Schrader et al. | |
| 5,635,676 | A | 6/1997 | Piriz | |
| 5,898,131 | A | 4/1999 | Chadbourne et al. | |
| 6,099,344 | A | 8/2000 | Chadbourne | |
| 6,261,137 | B1 | 7/2001 | Wilcox | |
| 6,525,270 | B1 | 2/2003 | Connor et al. | |
| 6,538,204 | B2 | 3/2003 | Connor | |
| 7,511,224 | B1 | 3/2009 | Kossak | |
| 7,766,704 | B2 * | 8/2010 | Robinson | H01R 4/36 439/814 |
| 9,368,296 | B2 * | 6/2016 | Holland | H01H 31/125 |
| 9,577,351 | B2 | 2/2017 | Martin | |
| 2003/0010524 | A1 | 1/2003 | Connor | |
| 2014/0152949 | A1 | 9/2014 | Evan | |
| 2015/0229037 | A1 | 8/2015 | Uchida | |

OTHER PUBLICATIONS

Office Action mailed in corresponding CN 2019213515697, dated Mar. 10, 2020.

* cited by examiner

INSULATION PIERCING CONNECTOR

CROSS REFERENCE TO RELATED APPLICATIONS

The present disclosure is based on and claims benefit from U.S. Provisional Patent Application Ser. No. 62/719,934 filed on Aug. 20, 2018 entitled "Insulation Piercing Connector" the contents of which are incorporated herein in their entirety by reference.

BACKGROUND

Field

The present disclosure relates generally to electrical connectors for connecting one or more solid or stranded wires or conductors of one size to one or more wires or conductors of another size. More specifically, the present disclosure relates to mechanical-type electrical connectors for connecting one or more branch wires or conductors to one or more run wires or conductors.

Description of the Related Art

Tap connectors have been used to establish an electrical connection between a continuous main power conductor and a branch conductor. Similarly, tap connectors have been used to establish an electrical connection between a distribution power conductor (also referred to as a run conductor) and one or more main power conductors. Such tap connectors are made of metal and form a portion of the electrically conductive path between the main or run conductors and the branch conductors. However, to establish the electrically conductive path between the main or run conductors and the branch conductors the insulation surrounding the electrical wires in the conductors has to be removed. Striping insulation surrounding electrical wires in the conductors is a time-consuming operation adding to the cost to install tap connectors.

Providing tap connectors that are made of an electrically conductive material and that include an insulation piercing feature to pierce or cut through the conductor insulation while making the mechanical connection between the conductors and the connector would decrease the time it takes to install tap connectors and thus decrease the cost to install them.

SUMMARY

The present disclosure provides exemplary embodiments of insulation piercing connectors used to connect run conductors to branch conductors. In one embodiment the connector includes a connector body and a removable cap. The connector body forms a run conductor opening and a branch conductor opening. The removable cap has a run cap portion and a branch cap portion. The run cap portion has a first bore for receiving an insulation piercing screw. The branch cap portion has a second bore for receiving a branch screw. In an exemplary embodiment, the insulation piercing screw includes a set screw having an insulation piercing member, e.g., a pointed tip. In an exemplary embodiment, the branch screw includes a set screw having a blunt or rounded tip or a set screw having an insulation piercing member, e.g., a pointed tip.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

Figure 1:
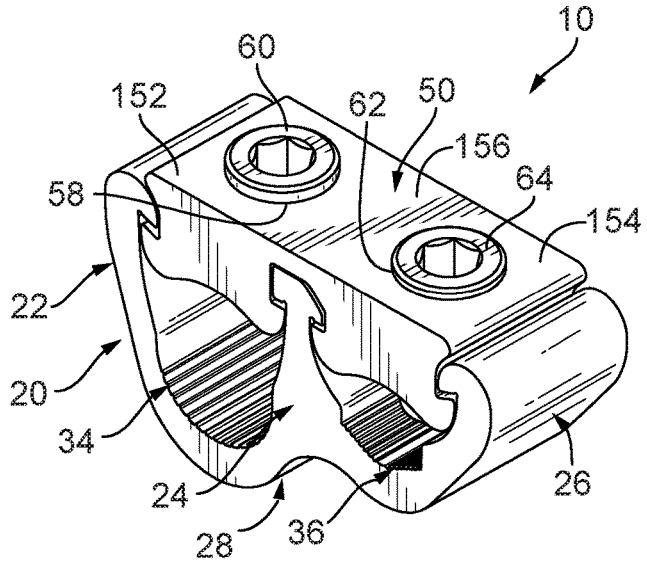
FIG. 1 is a perspective view of an exemplary embodiment of an insulation piercing connector according to the present disclosure.
Figure 3:
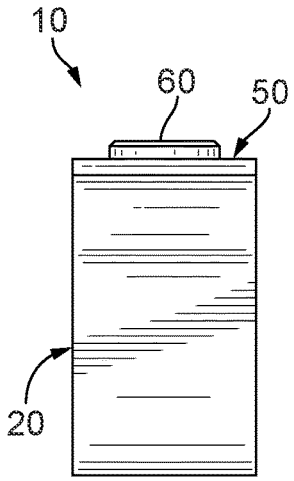
FIG. 3 is a side elevation view of a first side of the insulation piercing connector of FIG. 1.
Figure 2:
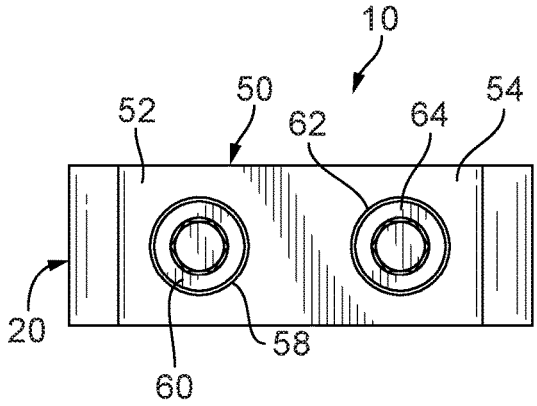
FIG. 2 is a top plan view of the insulation piercing connector of FIG. 1.
Figure 4:
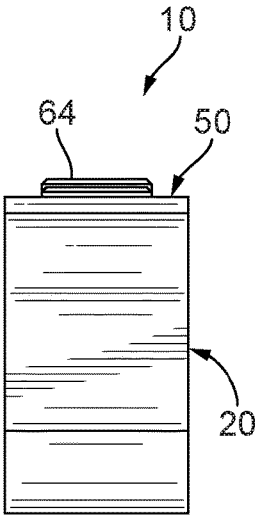
FIG. 4 is a side elevation view of a second side of the insulation piercing connector of FIG. 1.

The present disclosure provides embodiments of mechanical connectors used to electrically connect, for example, one or more branch or tap conductors to one or more run or main conductors. For ease of description, the insulation piercing connector may be referred to as the "connector" in the singular and the "connectors" in the plural. The branch or tap conductors may be referred to as the "branch conductor" in the singular and the "branch conductors" in the plural. The main or run conductors may be referred to as the "run conductor" in the singular and the "run conductors" in the plural. The port, slot, channel, aperture or other opening that receives the branch conductors may also be referred to as the "branch opening" in the singular and the "branch openings" in the plural. The port, slot, channel, aperture or other opening that receives the run conductors may also be referred to as the "run opening" in the singular and the "run openings" in the plural.

Referring to FIGS. 1-8, an exemplary embodiment of an insulation piercing connector according to the present disclosure is shown. In this exemplary embodiment, the connector 10 includes a body 20 and a removable cap 50. The body 20 includes a first end wall 22, a middle wall 24, a second end wall 26 and a base wall 28. The base wall 28 is positioned between and joined to the first end wall 22, the middle wall 24 and the second end wall 26 as shown. The body 20 is made of an electrically conductive material, such as aluminum, cast aluminum, copper, tin-plated copper, or similar metallic materials. The first end wall 22, middle wall 24, second end wall 26 and base wall 28 may be integrally or monolithically formed as a single structure, or they may be separate components joined together using welds or mechanical fasteners. Preferably, the body 20 is made by an extrusion process.

Figure 5:
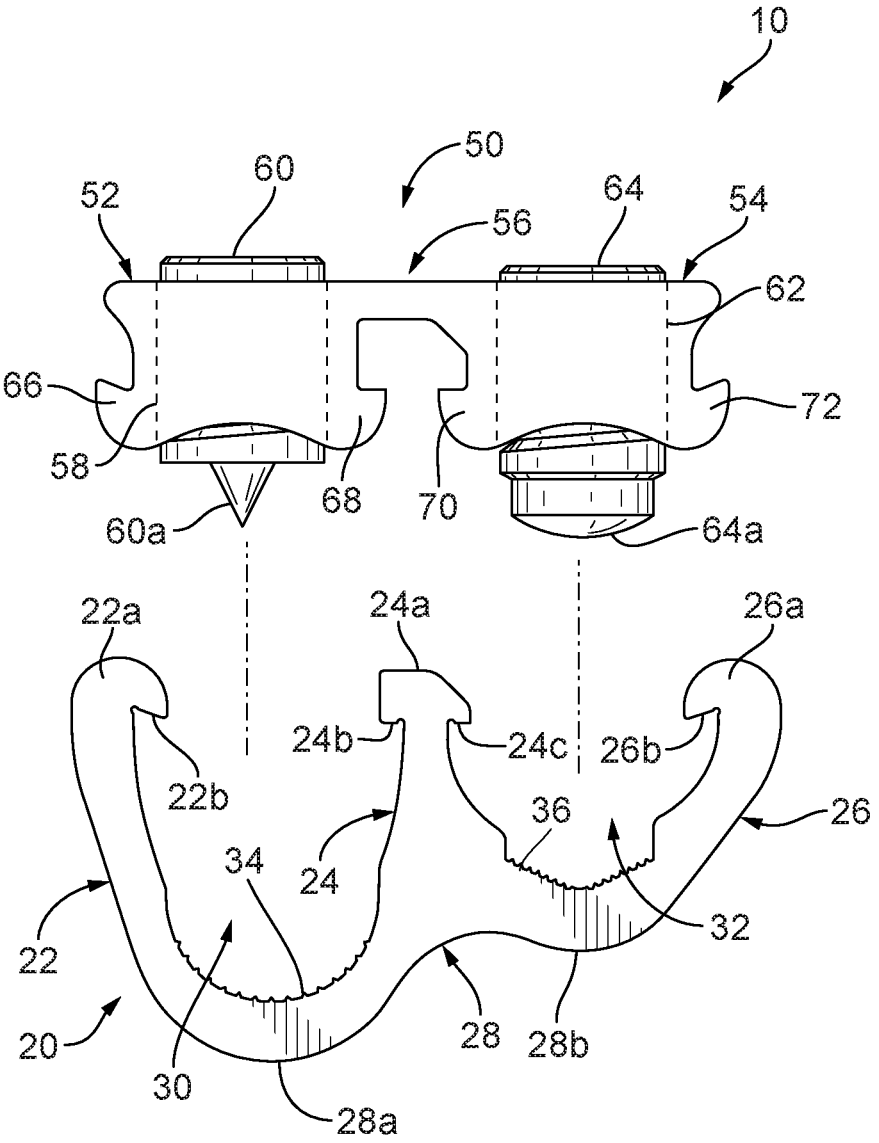
FIG. 5 is an exploded front elevation view of the insulation piercing connector of FIG. 1, illustrating a connector body and a connector cap separated from the connector body.
Figure 6:
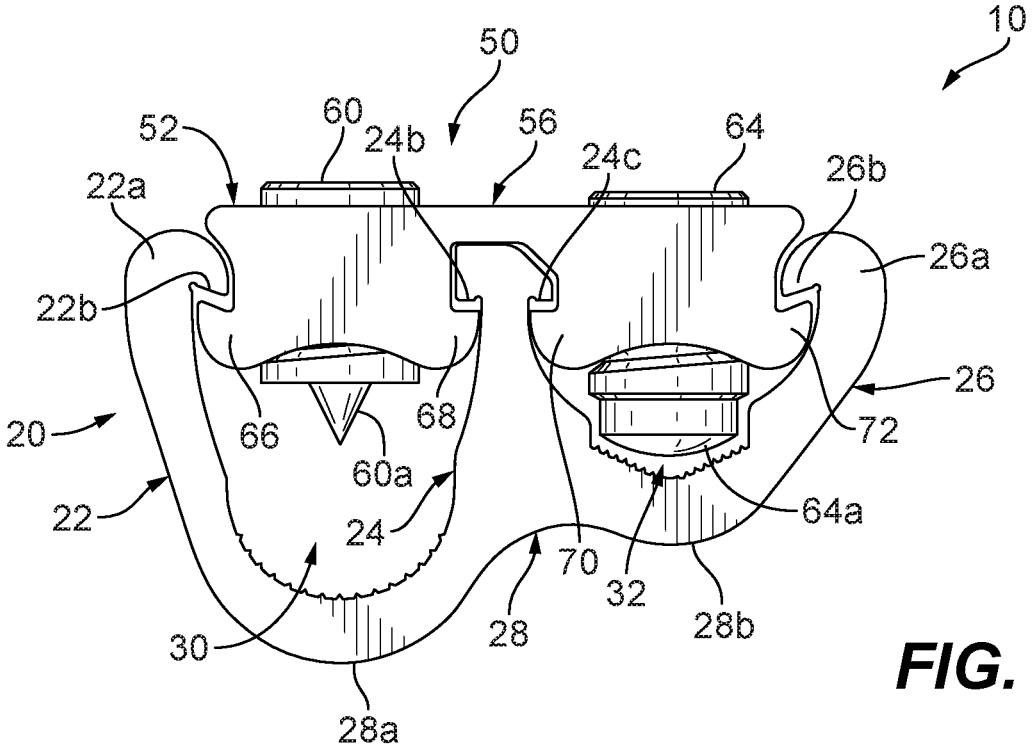
FIG. 6 is a front elevation view of the insulation piercing connector of FIG. 1, illustrating the connector cap attached to the connector body.

The first end wall 22, middle wall 24 and a portion 28*a*, seen in FIG. 5, of the base wall 28 define a portion of a run opening 30 of the connector 10. The size and configuration of the run opening 30 can vary depending upon the size of a run conductor 200, seen in FIG. 9, to be secured to the connector 10. As a non-limiting example, the size of the run conductor 200 can range from about 4/0 AWG to about 1000 Kc mil, such that the run opening 30 would need to be able to receive a run conductor in the that size range. The portion 28*a* of the base wall 28 facing the run opening 30 may include one or more conductor gripping members 34 used to better grip the run conductor 200. Non-limiting examples of the gripping members include one or more ridges, knurling, etc. that allow the gripping members 34 to better grip the run conductor 200. The second end wall 26, middle wall 24 and a portion 28*b*, seen in FIG. 5, of the base wall define a portion of a branch opening 32 of the connector 10, seen in FIG. 9. The size and configuration of the branch opening 32 can vary depending upon the size of the branch conductor. As a non-limiting example, the size of the branch conductor 210, seen in FIG. 9, can range from about 10 AWG to about #1 AWG, such that the branch opening 32 would need to be able to receive a branch conductor in that size range. The portion 28*b* of the base wall 28 facing the branch opening 32 may include one or more conductor gripping members 36 used to better grip the branch conductor 210. Non-limiting examples of the gripping members include one or more ridges, knurling, etc. that allow the gripping members 36 to better grip the branch conductor 210.

As shown in FIG. 5, the first end wall 22 of the body 20 includes a free end 22*a* having a first shoulder 22*b*. The middle wall 24 of the body 20 includes a free end 24*a* having a second shoulder 24*b* and a third shoulder 24*c*. The second end wall 26 of the body 20 includes a free end 26*a* having fourth shoulder 26*b*. The first and second shoulders 22*a* and 24*b*, and the third and fourth shoulders 24*c* and 26*b* are used to releasably attach the cap 50 to the body 20, as described below.

The removable cap 50, which may also be referred to herein as the "cap," includes a run cap portion 52 and a branch cap portion 54 that are coupled together via a bridge portion 56. The removable cap 50 is made of an electrically conductive material, such as aluminum, cast aluminum, copper, tin-plated copper, or similar metallic materials. The run cap portion 52, branch cap portion 54 and bridge portion 56 may be integrally or monolithically formed as a single structure, or they may be separate components joined together using welds or mechanical fasteners. Preferably, the cap 50 is made by an extrusion process. The run cap portion 52 of the cap 50 forms a portion of the run opening 30 when the cap 50 is attached to the body 20. The run cap portion 52 of the cap 50 includes a threaded aperture 58, seen in FIG. 5, configured to receive a threaded run screw 60, seen in FIG. 7, that is used to releasably secure a run conductor 200, seen in FIG. 9, to the connector 10. The branch cap portion 54 of the cap 50 forms a portion of the branch opening 32 when the cap 50 is attached to the body 20. The branch cap portion 54 of the cap 50 includes a threaded aperture 62, seen in FIG. 5, configured to receive a threaded branch screw 64, seen in FIG. 8, that is used to releasably secure a branch conductor 210, seen in FIG. 9, to the connector 10.

Figure 7:
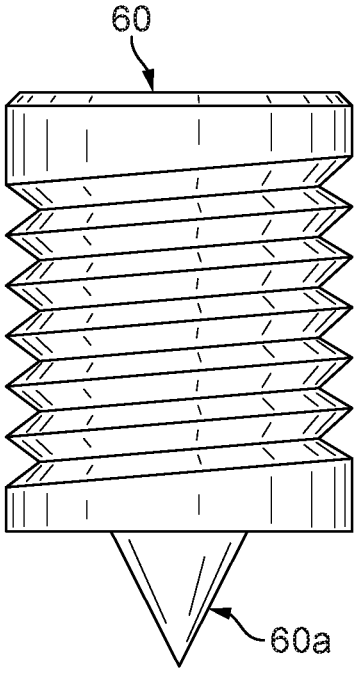
FIG. 7 is a side elevation view of a run conductor insulation piercing screw used to secure a run conductor to the insulation piercing connector of FIG. 1 and to pierce insulation surrounding the run conductor to create an electrical path between the run conductor and the insulation piercing connector.
Figure 8:
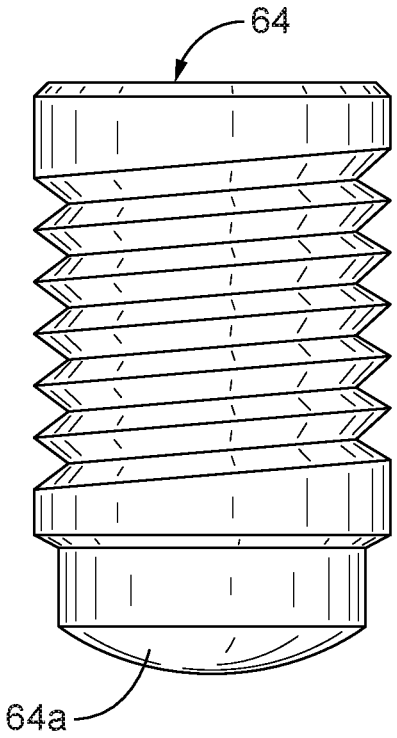
FIG. 8 is a side elevation view of a branch conductor screw used to secure a branch conductor to the insulation piercing connector of FIG. 1 and to create an electrical path between the branch conductor and the insulation piercing connector.

Turning to FIGS. 7 and 8, in this exemplary embodiment, the run screw 60, seen in FIG. 7, is a threaded set screw that includes one or more insulation piercing members 60*a* used to pierce through insulation surrounding electrical wires of a run conductor 200 and to contact the electrical wires to create an electrically conductive path between the run conductor 200 and the cap 50 via the run screw 60. In this exemplary embodiment, the one or more insulation piercing members 60*a* is a pointed tip. However, the present disclosure contemplates using a plurality of insulation piercing members, e.g., a plurality of pointed tips. The present disclosure also contemplates that the one or more insulation piercing members 60*a* may include other structures to pierce through insulation surrounding the run conductor 200, such as for example, a circular or linear member with a cutting edge or a serrated edge. The branch screw 64, seen in FIG. 8, is a threaded set screw that has a blunt or rounded tip that contacts bare electrical wires of the branch conductor 210 to create an electrically conductive path between the branch conductor 210 and the cap 50 via the branch screw 64.

Referring again to FIGS. 1-6, the cap 50 in the exemplary embodiment shown is a slide-on type cap, where the cap 50 slides into engagement with the body 20. More specifically, the run cap portion 52 includes a pair of hooks 66 and 68 that interlock with shoulders 22*b* and 24*b* of the body 20. The first hook 66 is positioned on the cap 50 to mate with shoulder 22*b* associated with the first end wall 22 of the body 20, and the second hook 68 is positioned on the cap 50 to mate with shoulder 24*b* associated with the middle wall 24 of the body 20. Similarly, the branch cap portion 54 includes a pair of hooks 70 and 72 that interlock with shoulders 24*c* and 26*b* of the body 20. The first hook 70 is positioned on the cap 50 to mate with shoulder 24*c* associated with the middle wall 24 of the body 20, and the second hook 72 is positioned on the cap 50 to mate with shoulder 26*b* associated with the second end wall 26 of the body 20.

To releasably secure the cap 50 to the body 20, the cap is attached to the body by sliding the cap 50 into the body 20 so that the first shoulder 22*b* is aligned with the first hook 66, the second shoulder 24*b* is aligned with the second hook 68, the third shoulder 24*c* is aligned with the third hook 70 and the fourth shoulder 26*b* is aligned with the fourth hook 72. The run screw 60 and the branch screw 64 can then be tightened to secure the cap 50 to the body 20. When the run screw 60 is tightened, the first and second hooks 66 and 68 on the cap 50 engage the first and second shoulders 22*b* and 24*b*, respectively, on the body 20 to bind the run cap portion 52 to the body. Similarly, when the branch screw 64 is tightened, the third and fourth hooks 70 and 72 on the cap 50 engage the third and fourth shoulders 24*c* and 26*b*, respectively, on the body 20 to bind the branch cap portion 54 to the body.

Figure 9:
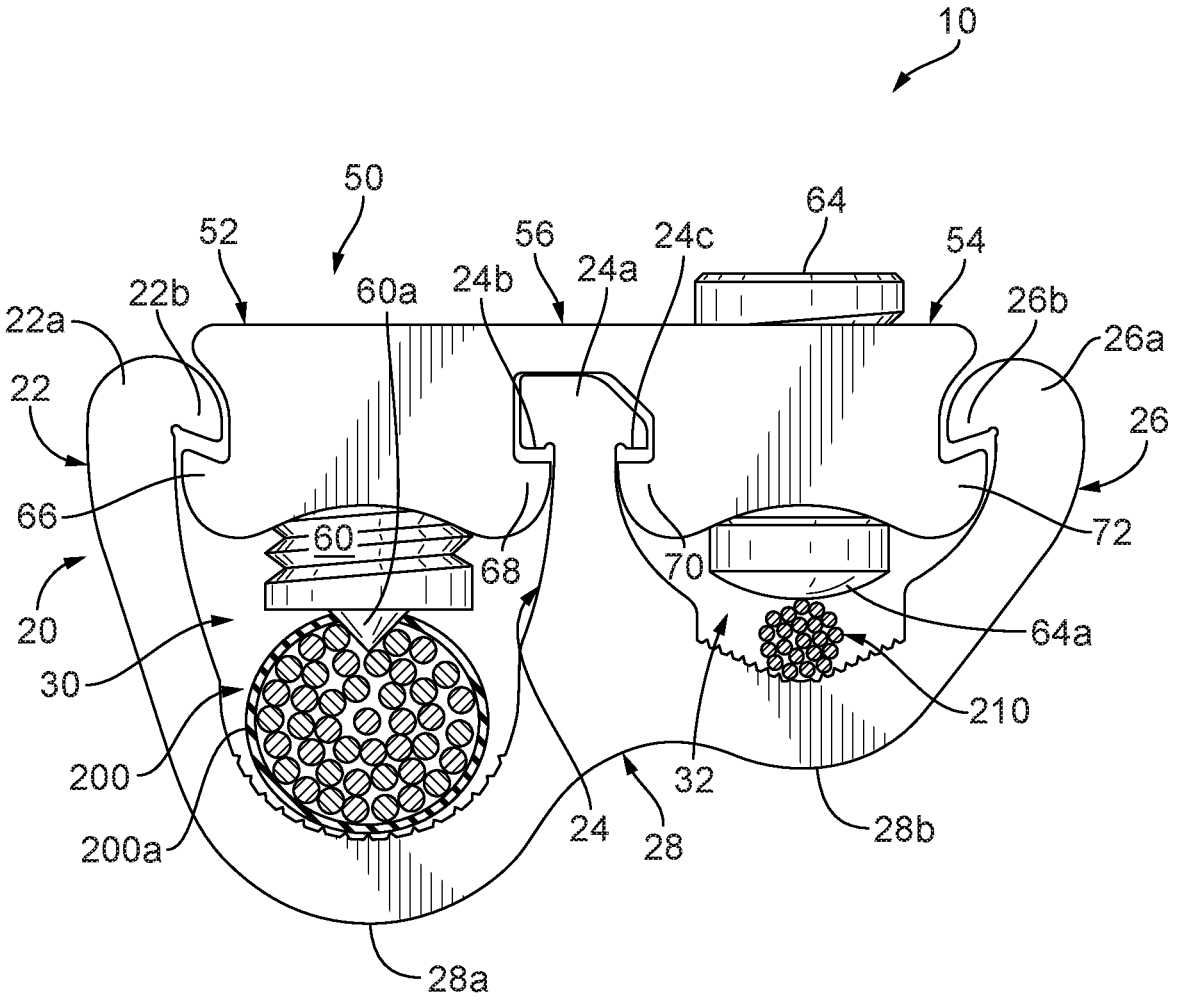
FIG. 9 is a front elevation view of the insulation piercing connector of FIG. 6, illustrating a run conductor secured to the connector within a run conductor opening and piercing insulation surrounding the run conductor to contact electrical wires within the run conductor, and a branch conductor secured to the connector within a branch conductor opening.
Figure 10:
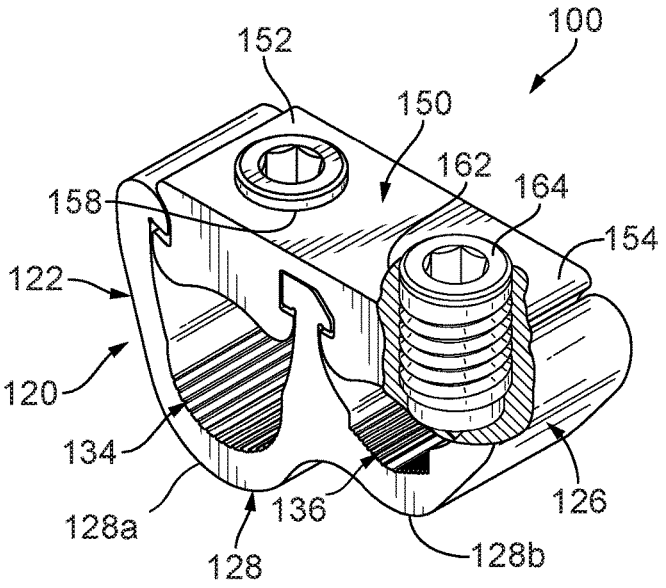
FIG. 10 is a perspective view of another exemplary embodiment of an insulation piercing connector according to the present disclosure.
Figure 12:
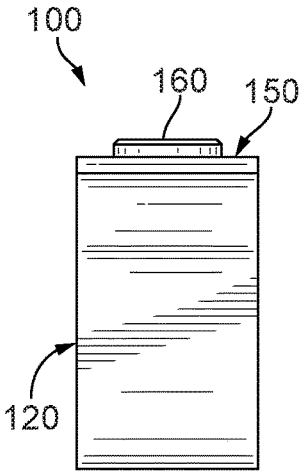
FIG. 12 is a side elevation view of a first side of the insulation piercing connector of FIG. 10.
Figure 11:
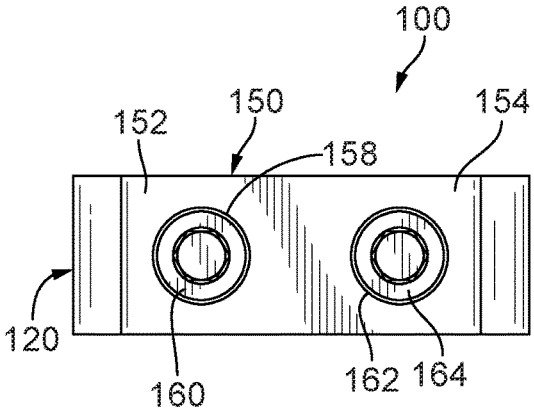
FIG. 11 is a top plan view of the insulation piercing connector of FIG. 10.
Figure 13:
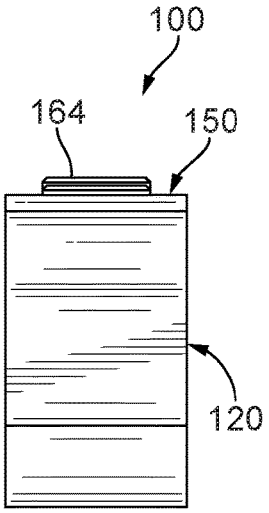
FIG. 13 is a side elevation view of a second side of the insulation piercing connector of FIG. 10.

Referring to FIG. 9, the connecting of a run conductor and a branch conductor to the connector 10 will be described. Initially, insulation surrounding a portion of a branch conductor 210 is removed from the branch conductor 210 and the bare portion of the branch conductor is inserted into the branch conductor opening 32 of the connector 10. If the branch conductor 210 does not have insulation surrounding the electrical wires, then a free end of the branch conductor 210 is inserted into the branch conductor opening 32 of the connector 10. A run conductor 200 is inserted into the run conductor opening 30 of the connector 10. The cap 50 is the attached to the body 20 as described above, and the branch screw 64 is tightened to secure the branch conductor 210 to the connector 10 and to bind the branch cap portion 54 of the cap 50 to the body 20 as described above. When the branch conductor 210 is secured to the connector 10, an electrically conductive path is created between the connector 10 and the branch conductor 210 via the body 20, the branch screw 64 and the cap 50. The run screw 60 is also tightened to secure the run conductor 200 to the connector 10 and to bind the run cap portion 52 of the cap 50 to the body 20 as described above. When the run conductor 200 is secured to the connector 10, the one or more insulation piercing members 60*a* extending from the run screw 60 pierce or cut through the insulation 200*a* surrounding electrical wires within the run conductor 200 and contacts the electrical wires so that an electrically conductive path is created between the connector 10 and the run conductor 200 via the one or more insulation piercing members 60*a*, the run screw 60 and the cap 50. Overall, when the connector 10 is secured to a run conductor 200 and one or more branch conductors 210, an electrically conductive path is created between the run conductor 200 and the branch conductor 210 such that, for example, electrical current flowing through the run conductor 200 can flow through the branch conductor 210.

Referring to FIGS. 10-17, another exemplary embodiment of an insulation piercing connector according to the present disclosure is shown. In this exemplary embodiment, the connector 100 includes a body 120 and a removable cap 150. The body 120 includes a first end wall 122, a middle wall 124, a second end wall 126 and a base wall 128. The base wall 128 is positioned between and joined to the first end wall 122, the middle wall 124 and the second end wall 126 as shown. The body 120 is made of an electrically conductive material, such as aluminum, cast aluminum, copper, tin-plated copper, or similar metallic materials. The first end wall 122, middle wall 124, second end wall 126 and base wall 128 may be integrally or monolithically formed as a single structure, or they may be separate components joined together using welds or mechanical fasteners. Preferably, the body 120 is made by an extrusion process.

Figure 14:
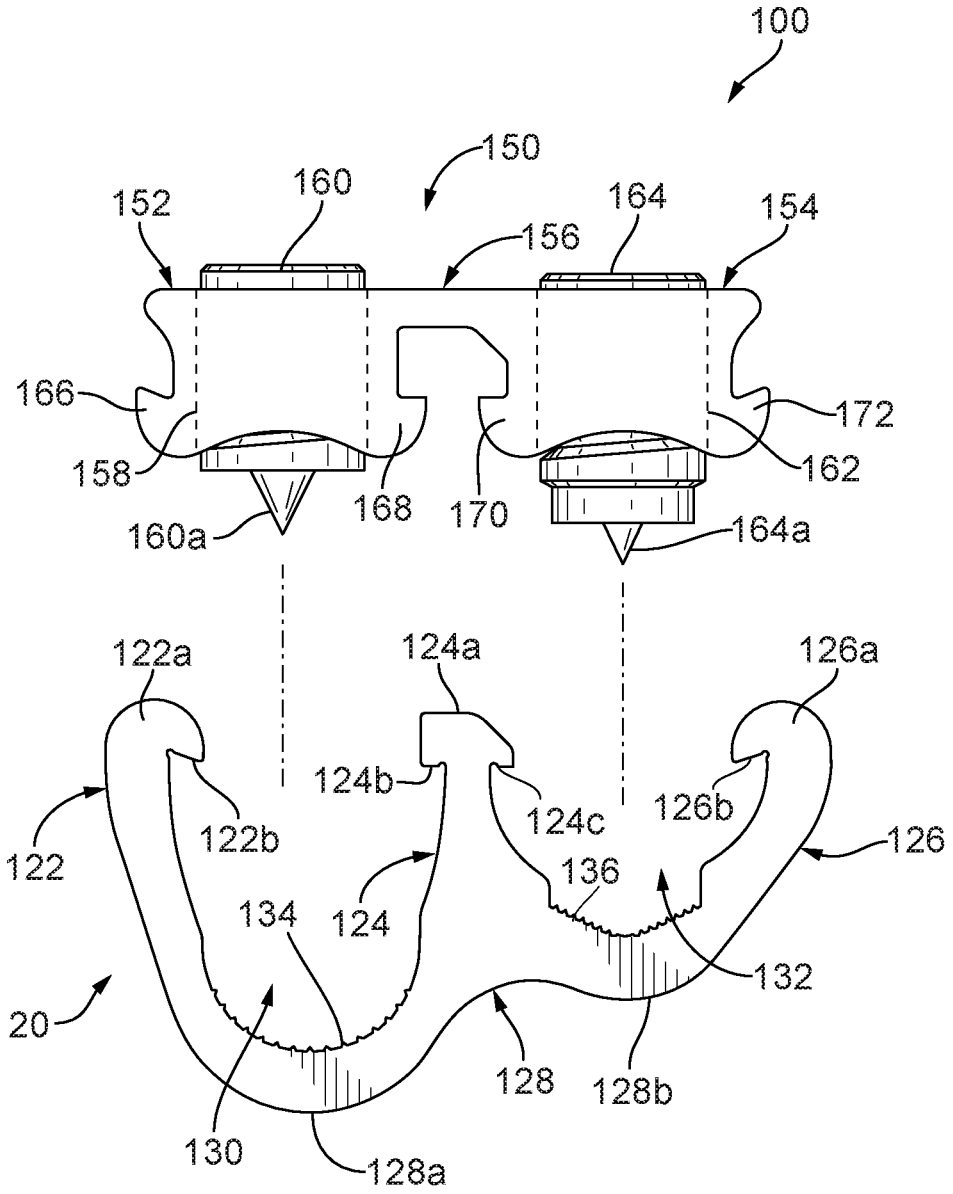
FIG. 14 is an exploded front elevation view of the insulation piercing connector of FIG. 10, illustrating a connector body and a connector cap separated from the connector body.
Figure 15:
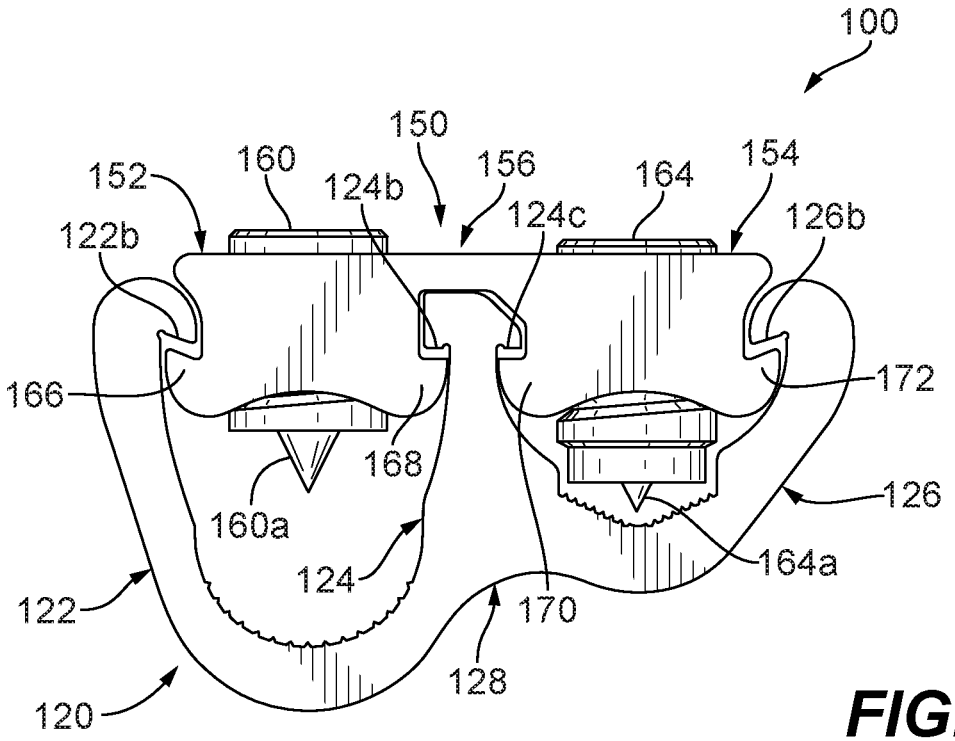
FIG. 15 is a front elevation view of the insulation piercing connector of FIG. 10, illustrating the connector cap attached to the connector body.

The first end wall 122, middle wall 124 and a portion 128*a*, seen in FIG. 14, of the base wall 128 define a portion of a run opening 130 of the connector 100. The size and configuration of the run opening 130 can vary depending upon the size of a run conductor 200, seen in FIG. 18, to be secured to the connector 100, seen in FIG. 18. As a non-limiting example, the size of the run conductor 200 can range from about 4/0 AWG to about 1000 Kcmil, such that the run opening 130 would need to be able to receive a run conductor in that size range. The portion 128*a* of the base wall 128 facing the run opening 130 may include one or more conductor gripping members 134 used to better grip the run conductor 200. Non-limiting examples of the gripping members include one or more ridges, knurling, etc. that allow the gripping members 134 to better grip the run conductor 200. The second end wall 126, middle wall 124 and a portion 128*b*, seen in FIG. 14, of the base wall define a portion of a branch opening 132 of the connector 100. The size and configuration of the branch opening 132 can vary depending upon the size of the branch conductor. As a non-limiting example, the size of the branch conductor can range from 10 AWG to about #1 AWG, such that the branch opening 132 would need to be able to receive a branch conductor in that size range. The portion 128*b* of the base wall 128 facing the branch opening 132 may include one or more conductor gripping members 136 used to better grip the branch conductor 210. Non-limiting examples of the gripping members include one or more ridges, knurling, etc. that allow the gripping members 136 to better grip the branch conductor 210.

As shown in FIG. 14, the first end wall 122 of the body 120 includes a free end 122*a* having a first shoulder 122*b*. The middle wall 124 of the body 120 includes a free end 124*a* having a second shoulder 124*b* and a third shoulder 124*c*. The second end wall 126 of the body 120 includes a free end 126*a* having fourth shoulder 126*b*. The first and second shoulders 122*a* and 124*b*, and the third and fourth shoulders 124*c* and 126*b* are used to releasably attach the cap 150 to the body 120, as described below.

The removable cap 150, which may also be referred to herein as the "cap," includes a run cap portion 152 and a branch cap portion 154 that are coupled together via a bridge portion 156. The removable cap 150 is made of an electrically conductive material, such as aluminum, cast aluminum, copper, tin-plated copper, or similar metallic materials. The run cap portion 152, branch cap portion 154 and bridge portion 156 may be integrally or monolithically formed as a single structure, or they may be separate components joined together using welds or mechanical fasteners. Preferably, the cap 150 is made by an extrusion process. The run cap portion 152 of the cap 150 forms a portion of the run opening 130 when the cap 150 is attached to the body 120. The run cap portion 152 of the cap 150 includes a threaded aperture 158, seen in FIG. 14, configured to receive a threaded run screw 160, seen in FIG. 16, that is used to releasably secure a run conductor 200, seen in FIG. 18, to the connector 100. The branch cap portion 154 of the cap 150 forms a portion of the branch opening 132 when the cap 150 is attached to the body 120. The branch cap portion 154 of the cap 150 includes a threaded aperture 162, seen in FIG. 14, configured to receive a threaded branch screw 164, seen in FIG. 17, that is used to releasably secure a branch conductor 210, seen in FIG. 18, to the connector 100.

Figure 16:
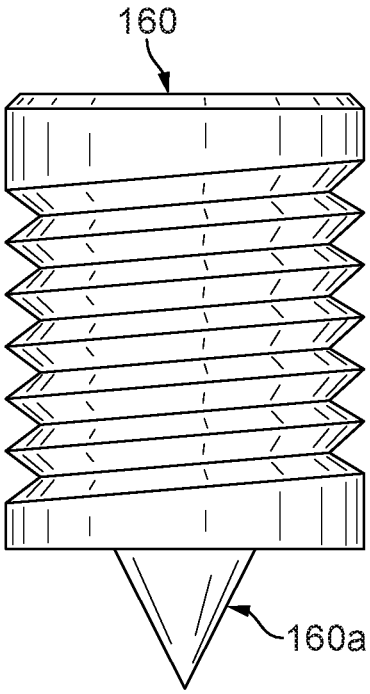
FIG. 16 is a side elevation view of a run conductor insulation piercing screw used to secure a run conductor to the insulation piercing connector of FIG. 10 and to pierce insulation surrounding the run conductor to create an electrical path between the run conductor and the insulation piercing connector.
Figure 17:
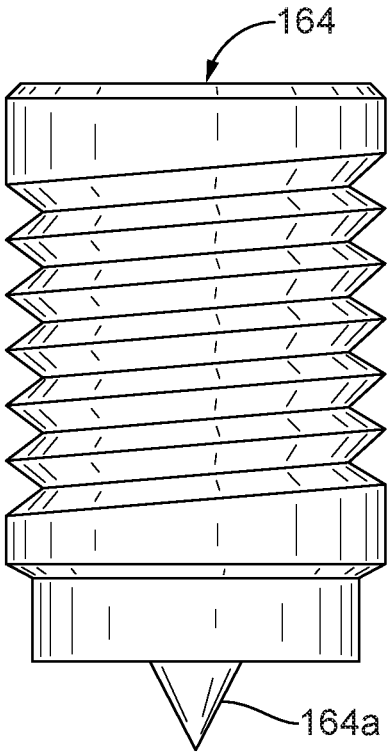
FIG. 17 is a side elevation view of a branch conductor screw used to secure a branch conductor to the insulation piercing connector of FIG. 10 and to pierce insulation surrounding the branch conductor to create an electrical path between the branch conductor and the insulation piercing connector.

Turning to FIGS. 16 and 17, in this exemplary embodiment, the run screw 160, seen in FIG. 16, is a threaded set screw that includes one or more insulation piercing members 160*a* used to pierce through insulation surrounding electrical wires of a run conductor 200 and to contact the electrical wires to create an electrically conductive path between the run conductor 200 and the cap 150 via the run screw 160. The branch screw 164, seen in FIG. 17, is a threaded set screw that includes one or more insulation piercing members 164*a* used to pierce through insulation surrounding electrical wires of a branch conductor 210 and to contact the electrical wires to create an electrically conductive path between the branch conductor 210 and the cap 150 via the branch screw 164. In this exemplary embodiment, the one or more insulation piercing members 160*a* and 164*a* are pointed tips. However, the present disclosure contemplates using a plurality of insulation piercing members, e.g., a plurality of pointed tips. The present disclosure also contemplates that the one or more insulation piercing members 160*a* and 164*a* may include other structures to pierce through insulation surrounding the run conductor 200 and the branch conductor 210, such as for example, a circular or linear member with a cutting edge or a serrated edge.

Referring again to FIGS. 10-15, the cap 150 in the exemplary embodiment shown is a slide-on type cap, where the cap 150 slides into engagement with the body 120. More specifically, the run cap portion 152 includes a pair of hooks 166 and 168 that interlock with shoulders 122*b* and 124*b* of the body 120. The first hook 166 is positioned on the cap 150 to mate with shoulder 122*b* associated with the first end wall 122 of the body 120, and the second hook 168 is positioned on the cap 150 to mate with shoulder 124*b* associated with the middle wall 124 of the body 120. Similarly, the branch cap portion 154 includes a pair of hooks 170 and 172 that interlock with shoulders 124*c* and 126*b* of the body 120. The first hook 170 is positioned on the cap 150 to mate with shoulder 124*c* associated with the middle wall 124 of the body 120, and the second hook 172 is positioned on the cap 150 to mate with shoulder 126*b* associated with the second end wall 126 of the body 120.

To releasably secure the cap 150 to the body 120, the cap is attached to the body by sliding the cap 150 into the body 120 so that the first shoulder 122*b* is aligned with the first hook 166, the second shoulder 124*b* is aligned with the second hook 168, the third shoulder 124*c* is aligned with the third hook 170 and the fourth shoulder 126*b* is aligned with the fourth hook 172. The run screw 160 and the branch screw 164 can then be tightened to secure the cap 150 to the body 120. When the run screw 160 is tightened, the first and second hooks 166 and 168 on the cap 150 engage the first and second shoulders 122*b* and 124*b*, respectively, on the body 120 to bind the run cap portion 152 to the body. Similarly, when the branch screw 164 is tightened, the third and fourth hooks 170 and 172 on the cap 150 engage the third and fourth shoulders 124*c* and 126*b*, respectively, on the body 120 to bind the branch cap portion 154 to the body.

Figure 18:
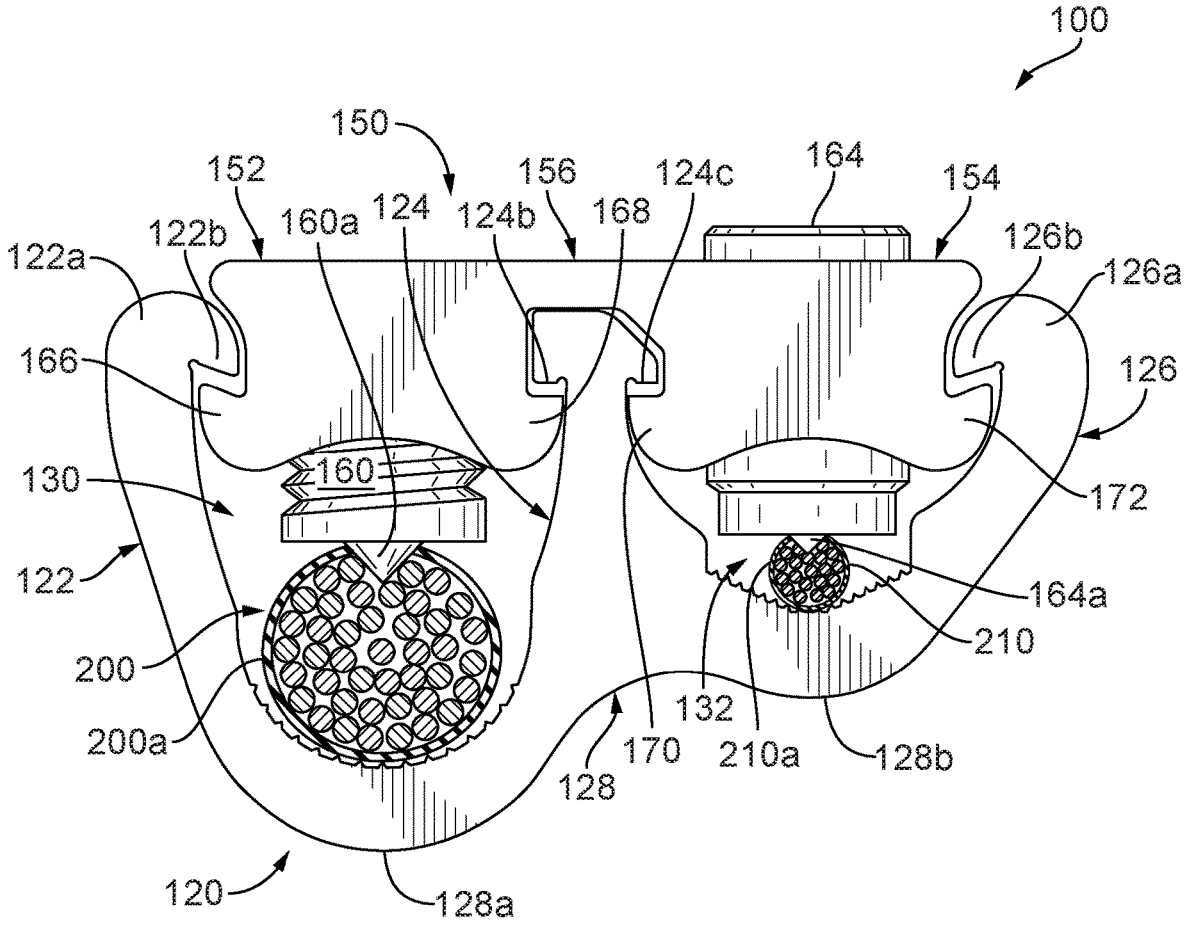
FIG. 18 is a front elevation view of the insulation piercing connector of FIG. 15, illustrating a run conductor secured to the connector within a run conductor opening and piercing insulation surrounding the run conductor to contact electrical wires within the run conductor, and a branch conductor secured to the connector within a branch conductor opening and piercing insulation surrounding the branch conductor to contact electrical wires within the branch conductor.

Referring to FIG. 18, the connecting of a run conductor and a branch conductor to the connector 100 will be described. A branch conductor 210 is inserted into the branch conductor opening 132 of the connector 100, and a run conductor 200 is inserted into the run conductor opening 130 of the connector. The cap 150 is the attached to the body 120 as described above, and the branch screw 164 is tightened to secure the branch conductor 210 to the connector 100 and to bind the branch cap portion 154 of the cap 150 to the body 120 as described above. When the branch conductor 210 is secured to the connector 100, the insulation piercing member 164*a* extending from the branch screw 164 pierces or cuts through the insulation 210*a* surrounding electrical wires within the branch conductor 210 and contacts the electrical wires so that an electrically conductive path is created between the connector 100 and the branch conductor 210 via the body 120, the one or more insulation piercing members 164*a*, the branch screw 164 and the cap 150. The run screw 160 is also tightened to secure the run conductor 200 to the connector 100 and to bind the run cap portion 152 of the cap 150 to the body 120 as described above. When the run conductor 200 is secured to the connector 100, the one or more insulation piercing members 160*a* extending from the run screw 160 pierces or cuts through the insulation 200*a* surrounding electrical wires within the run conductor 200 and contacts the electrical wires so that an electrically conductive path is created between the connector 100 and the run conductor 200 via the body 120, the one or more insulation piercing members 160*a*, the run screw 160 and the cap 150. Overall, when the connector 100 is secured to a run conductor 200 and one or more branch conductors 210, an electrically conductive path is created between the run conductor 200 and the branch conductor 210 such that, for example, electrical current flowing through the run conductor 200 can flow through the branch conductor 210.

The connectors described in the present disclosure can be manufactured from tin-plated copper, aluminum or similar metallic materials capable of forming a portion of an electrical circuit to carry current between run and branch conductors. Further, the run conductors are typically greater in size than the branch conductors. The run conductors and the branch conductors can be solid conductors or they can be stranded conductors. Typically, the run conductors and branch conductors are stranded conductors, as shown in FIGS. 9 and 18.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A connector for connecting a plurality of conductors, the connector comprising:

a connector body having a first end wall, a second end wall, and a middle wall disposed between the first and second end walls and including a free end with a shoulder extending therefrom, the first end wall and middle wall forming a run conductor opening and the second end wall and middle wall forming a branch conductor opening; and a monolithically formed removable cap having a run cap portion, a branch cap portion and a bridge portion between the run cap portion and the branch cap portion, the run cap portion having a first bore for receiving a first fastener having a first insulation piercing member configured to pierce through insulation surrounding one of the plurality of conductors and contact the one of the plurality of conductors to create an electrically conductive path between the one of the plurality of conductors, the first fastener and the removable cap, the branch cap portion having a second bore for receiving a second fastener, and the bridge portion being configured to receive the free end of the middle wall and engage the shoulder to interlock the removable cap with the connector body.

2. The connector according to claim 1, wherein the first fastener comprises a set screw having the first insulation piercing member extending from the set screw.

3. The connector according to claim 2, wherein the first insulation piercing member comprises a pointed tip.

4. The connector according to claim 1, wherein the second fastener comprises a set screw having a blunt or rounded tip.

5. The connector according to claim 1, wherein the second fastener comprises a set screw having a second insulation piercing member extending from the set screw.

6. The connector according to claim 5, wherein the second insulation piercing member comprises a pointed tip.

7. The connector according to claim 1, wherein the removable cap is removably coupled to the connector body.

8. The connector according to claim 7, wherein the removable cap includes a plurality of hooks and the connector body includes a plurality of shoulders capable of engaging the hooks when the removable cap is coupled to connector body.

9. A connector for connecting a plurality of conductors, the connector comprising:

a connector body having a first end wall, a second end wall, and a middle wall disposed between the first and second end walls and including a free end with a shoulder extending therefrom, the first end wall and middle wall forming a run conductor opening and the second end wall and middle wall forming a branch conductor opening; and a monolithically formed removable cap having a run cap portion, a branch cap portion and a bridge portion between the run cap portion and the branch cap portion, the run cap portion having a first bore for receiving a first fastener, the first fastener having a first insulation piercing member configured to pierce through insulation surrounding a first of the plurality of conductors and contact the first of the plurality of conductors to create an electrically conductive path between the first of the plurality of conductors, the first fastener and the removable cap, and the branch cap portion having a second bore for receiving a second fastener, the second fastener having a second insulation piercing member configured to pierce through insulation surrounding a second of the plurality of conductors and contact the second of the plurality of conductors to create an electrically conductive path between the second of the plurality of conductors, the second fastener and the removable cap, and the bridge portion being configured to receive the free end of the middle wall and engage the shoulder to interlock the removable cap with the connector body.

10. The connector according to claim 9, wherein the first fastener comprises a set screw and the first insulation piercing member extends from an end of the set screw.

11. The connector according to claim 9, wherein the first insulation piercing member comprises a pointed tip.

12. The connector according to claim 9, wherein the second fastener comprises a set screw and the second insulation piercing member extends from an end of the set screw.

13. The connector according to claim 9, wherein the second insulation piercing member comprises a pointed tip.

14. The connector according to claim 9, wherein the removable cap is removably coupled to the connector body.

15. The connector according to claim 14, wherein the removable cap includes a plurality of hooks and the connector body includes a plurality of shoulders capable of engaging the hooks when the removable cap is coupled to connector body.

16. A connector for connecting a plurality of conductors, the connector comprising:

a connector body having a first end wall, a second end wall, and a middle wall disposed between the first and second end walls and including a free end with a shoulder extending therefrom, the first end wall and middle wall forming a run conductor opening and the second end wall and middle wall forming a branch conductor opening; and a monolithically formed removable cap having a run cap portion, a branch cap portion and a bridge portion between the run cap portion and the branch cap portion, the bridge portion being configured to receive the free end of the middle wall and engage the shoulder to couple the removable cap with the connector body, the run cap portion being aligned with the run conductor opening when the cap is coupled to the connector body and the branch cap portion being aligned with the branch conductor opening when the cap is coupled to the connector body, the run cap portion having a first bore for receiving a first fastener, the first fastener having a first insulation piercing member extending therefrom and configured to pierce through insulation surrounding a first of the plurality of conductors and contact the first of the plurality of conductors to create an electrically conductive path between the first of the plurality of conductors, the first fastener and the removable cap, and the branch cap portion having a second bore for receiving a second fastener, the second fastener having a second insulation piercing member extending therefrom and configured to pierce through insulation surrounding a second of the plurality of conductors and contact the second of the plurality of conductors to create an electrically conductive path between the second of the plurality of conductors, the second fastener and the removable cap.

17. The connector according to claim 16, wherein the first fastener comprises a set screw and the first insulation piercing member extends from the set screw.

18. The connector according to claim 16, wherein the first insulation piercing member comprises a pointed tip.

19. The connector according to claim 16, wherein the second fastener comprises a set screw and the second insulation piercing member extends from the set screw.

20. The connector according to claim 16, wherein the second insulation piercing member comprises a pointed tip.

* * * * *